United States Patent [19]

Tomaszewski et al.

[11] Patent Number: 4,469,569

[45] Date of Patent: Sep. 4, 1984

[54] CYANIDE-FREE COPPER PLATING PROCESS

[75] Inventors: Lillie C. Tomaszewski; Thaddeus W. Tomaszewski, both of Dearborn, Mich.

[73] Assignee: OMI International Corporation, Warren, Mich.

[21] Appl. No.: 455,353

[22] Filed: Jan. 3, 1983

[51] Int. Cl.[3] ..... C25D 3/38

[52] U.S. Cl. ..... 204/52 R

[58] Field of Search ..... 204/52 R, 106

[56] References Cited

U.S. PATENT DOCUMENTS

| | | | |
|---|---|---|---|
| 2,709,847 | 6/1955 | Ihrie et al. | 204/38 B X |
| 3,475,293 | 10/1969 | Haynes et al. | 204/48 |
| 3,706,634 | 12/1972 | Kowalski | 204/46 |
| 3,706,635 | 12/1972 | Kowalski | 204/46 |
| 3,833,486 | 9/1974 | Nobel et al. | 204/44 |
| 3,914,162 | 10/1975 | Kowalski | 204/46 G |
| 3,928,147 | 12/1975 | Kowalski | 204/29 |

FOREIGN PATENT DOCUMENTS

| | | | |
|---|---|---|---|
| 2076855 | 12/1981 | United Kingdom | 204/52 R |

OTHER PUBLICATIONS

S. Wakabayashi et al., J. De Physique, No. 4, pp. C1-241 to C1-244, Apr. 1977.

J. K. Dennis et al., "Nickel and Chromium Plating", pp. 67-68, (1972).

Allen G. Gray, "Modern Electroplating", pp. 8-10, (1953).

*Primary Examiner*—G. L. Kaplan

*Attorney, Agent, or Firm*—Richard P. Mueller

[57] ABSTRACT

A cyanide-free electrolyte and process for depositing a ductile, fine-grained, adherent copper plate usually of a thickness of about 0.015 to about 5 mils on ferrous-base, copper-base, zinc-base and the like conductive substrates. The electrolyte contains controlled effective amounts of cupric ions complexed with an organo-phosphonate chelating agent, an alkali carbonate as a bath stabilizing and buffering agent, hydroxyl ions to provide a pH on the alkaline side and preferably, a wetting agent. The copper plate is applied by electrolyzing the aforementioned electrolyte employing a combination of a bath soluble copper anode and an insoluble ferrite anode to provide a copper to ferrite anode surface area ratio within a range of about 1:2 to about 1:6.

32 Claims, No Drawings

CYANIDE-FREE COPPER PLATING PROCESS

BACKGROUND OF THE INVENTION

The use of cyanide salts in copper plating electrolytes has become environmentally disfavored because of ecological considerations. Accordingly, a variety of non-cyanide electrolytes for various metals have heretofore been proposed for use as replacements for the well-known and conventional commercially employed cyanide counterparts. For example, U.S. Pat. No. 3,475,293 discloses the use of certain diphosphonates for electroplating divalent metal ions; U.S. Pat. Nos. 3,706,634 and 3,706,635 disclose the use of combinations of ethylene diamine tetra (methylene phosphonic acid), 1-hydroxyethylidene-1,1-diphosphonic acid, and aminotri (methylene phosphonic acid) as suitable complexing agents for the metal ions in the bath; U.S. Pat. No. 3,833,486 discloses the use of water soluble phosphonate chelating agents for metal ions in which the bath further contains at least one strong oxidizing agent; while U.S. Pat. No. 3,928,147 discloses the use of an organophosphorus chelating agent for pretreatment of zinc die castings prior to electroplating with electrolytes of the types disclosed in U.S. Pat. 3,475,293, 3,706,634 and 3,706,635.

While the eleotrolytes and processes disclosed in the aforementioned U.S. patents have provided satisfactory electrodeposits under carefully controlled conditions, such electrolytes and processes have not received widespread commercial acceptance in view of one or more problems associated with their practice. A primary problem associated with such prior art electrolytes has been inadequate adhesion of the copper deposit to zinc and zinc alloy substrates. Another such problem relates to the sensitivity of such electrolytes to the presence of contaminants such as cleaners, salts of nickel plating solutions, chromium plating solutions and zinc metal ions introduced into the electrolyte during conventional commercial practice. Still another problem is the hazardous nature of strong oxidizing agents employed in certain of such prior art electrolytes.

The present invention overcomes many of the problems and disadvantages associated with prior art cyanide-free copper plating solutions by providing an electrolyte which is cyanide-free providing an environmentally manageable system, which will function to produce an adherent copper deposit on conductive substrates including steel, brass and zinc base metals such as zinc die casts and the like; which will efficiently produce ductile, fine-grained copper deposits at thicknesses usually ranging from about 0.015 to about 5 mils (0.000015 to about 0.005 inch), which is more tolerant of the presence of reasonable concentrations of contaminants such as cleaning compounds, salts of nickel and chromium plating solutions and zinc metal ions as normally introduced into a plating bath in a commercial practice, and which is of efficient and economical operation.

SUMMARY OF THE INVENTION

The benefits and advantages of the present invention are achieved in accordance with the composition aspects thereof by a cyanide-free aqueous alkaline electrolyte containing controlled, effective amounts of cupric ions, an organo-phosphonate chelating agent, an alkali carbonate, hydroxyl ions to provide a pH on the alkaline side, and optionally but preferably, a wetting agent.

The copper ions may be introduced by a bath soluble and compatible copper salt, to provide a cupric ion concentration in an amount sufficient to electrodeposit copper, and generally ranging from as low as about 3 to as high as about 50 grams per liter (g/l) under selected conditions. The organo-phosphonate chelating agent is a compound selected from the group consisting of 1-hydroxyethylidene-1,1-diphosphonic acid (HEDP) by itself present in an amount of about 50 to about 500 g/l, a mixture of HEDP and aminotri - (methylene phosphonic acid) (ATMP) in which HEDP is present in an amount of at least about 50 percent by weight of the mixture, and a mixture of HEDP and ethylenediamine tetra (methylene phosphonic acid) (EDTMP) in which HEDP is present in an amount of at least about 30 percent by weight of the mixture, as well as the bath soluble and compatible salts and partial salts thereof. When mixtures of HEDP and ATMP or HEDP and EDTMP are employed as the chelating agent instead of HEDP by itself, a reduction in the concentration of the chelating agent can be used due to the increased chelating capacity of the ATMP and EDTMP compounds in comparison to that of HEDP. The concentration of the organo-phosphonate chelating agent will range in relationship to the specific amount of copper ions present in the bath and is usually controlled to provide an excess of the chelating agent relative to the copper ions present.

In addition to the foregoing, the bath contains an alkali metal carbonate as a stabilizing agent as well as a buffering agent which is present in an amount usually of at least about 5 up to about 100 g/l with amounts of at least about 20 g/l being required in most instances. The bath further contains hydroxyl ions to provide an electrolyte on the alkaline side with a pH of about 7.5 up to about 10.5 while an alkalinity of about 9.5 to about 10 is usually preferred. The bath may optionally and preferably further contain a bath soluble and compatible wetting agent present in an amount up to about 0.25 g/l.

In accordance with the process aspects of the present invention, the cyanide-free electrolyte as hereinabove described is employed for electrode-positing a fine-grained ductile, adherent copper strike on conductive substrates including ferrous-base substrates such as steel, copper-base substrates such as copper, bronze and brass; and zinc-base substrates including zinc die castings. The substrate to be plated is immersed in the electrolyte as a cathode and a soluble copper anode in combination with an insoluble ferrite anode is employed to provide a copper anode to ferrite anode surface area ratio of about 1:2 to about 1:6. The electrolyte is electrolyzed by passage of current between the cathode and anode for a period of time of about 1 minute to as long as several hours and even days in order to deposit the desired thickness of copper on the cathodic substrate. The bath can be operated at a temperature of from about 100° to about 160° F. with temperatures of about 110° to about 140° F. being preferred. The particular temperature employed will vary depending on the specific bath composition in order to optimize plate characteristics. The bath can be operated at a current density of about 1 to about 80 amperes per square foot (ASF), depending on bath composition, employing a cathode to anode ratio usually of about 1:2 to about 1:6. It has been surprisingly discovered, that uniform, adherent and fine-grained deposits are obtained by electrofying the substrates prior to immersion in the electrolyte. In the case of zinc-base substrates, electrification of the part at a voltage of at least about 3 volts has been found necessary to attain satisfactory adhesion of the copper deposit. The specific operating parameters and composition of the electrolyte will vary depending upon the type of basis metal being plated, the desired thickness of the copper plate to be deposited, and time availability in consideration of the other integrated plating and rinsing operations.

Additional benefits and advantages of the present invention will become apparent upon a reading of the Description of the Preferred Embodiments considered in conjunction with the accompanying examples.

DESCRIPTION OF THE PREFERRED EMBODIMENTS

According to the composition aspects of the present invention, the cyanide-free electrolyte contains as its essential constituents, copper ions, an organo-phosphonate complexing agent in an amount sufficient to complex the copper ions present, a stabilizing agent comprising a bath soluble carbonate compound, hydroxyl ions to provide an alkaline pH, and optionally, a wetting agent.

The copper ions are introduced during make-up of the electrolyte by employing any one or mixtures of bath soluble and compatible copper salts such as sulfate, carbonates, oxides, hydroxides, and the like. Of the foregoing, copper sulfate in the form of the pentahydrate ($CuSO_4 \cdot 5H_2O$) is preferred. The copper ions are present in the bath within the range of about 3 up to about 50 g/l typically from around 5 to about 20 g/l. For example, when plating steel substrates, copper ion concentrations of about 15 up to about 50 g/l are employed to achieve a high rate of copper electro-deposition. In such instances in which the copper ion concentration is above about 20 g/l, it has been found by experimentation that electrified part entry into the bath is preferred to attain satisfactory adhesion. On the other hand, when plating zinc-base substrates such as zinc die castings, for example, copper ion concentrations of about 3.5 to about 10 g/l are preferred and in which instance the part must be electrified at the time of bath immersion to achieve an adherent deposit. During use of the electrolyte, a replenishment of the copper ions consumed during the electrodeposition operation as well as those removed by drag-out is achieved by the progressive dissolution of a copper anode employed in electrolyzing the bath.

The complexing or chelating agent comprises an organo-phosphorus ligand of an alkali metal and alkaline earth metal salt of which calcium is not suitable due to precipitation. Preferably, the complexing salt comprises an alkali metal such as sodium, potassium, lithium and mixtures thereof of which potassium constitutes the preferred metal. The complexing agent is present in the bath in consideration of the specific concentration of copper ions present.

The specific organo-phosphorus ligand suitable for use in accordance with the practice of the present invention comprises a compound selected from the group consisting of 1-hydroxyethylidene-1, 1-diphosphonic acid (HEDP) by itself present in an amount of about 50 to about 500 g/l, a mixture of HEDP and aminotri-(methylene phosphonic acid) (ATMP) in which HEDP is present in an amount of at least about 50 percent by weight of the mixture, and a mixture of HEDP and ethylenediamine tetra (methylene phosphonic acid) (EDTMP) in which HEDP is present in an amount of at least about 30 percent by weight of the mixture, as well as the bath soluble and compatible salts and partial salts thereof. When mixtures of HEDP and ATMP or HEDP and EDTMP are employed as the chelating agent instead of HEDP by itself, a reduction in the concentration of the chelating agent can be used due to the increased chelating capacity of the ATMP and EDTMP compounds in comparison to that of HEDP. Commercially available compounds of the foregoing types which can be satisfactorily employed in the practice of the present invention include Dequest 2010 (HEDP), Dequest 2000 (ATMP) and Dequest 2041 (EDTMP) available from Monsanto Company.

As previously indicated, the HEDP chelating agent can be employed at a concentration of about 50 g/l corresponding to a copper ion concentration of about 3 g/l up to a concentration of about 500 g/l corresponding to a copper ion concentration of about 50 g/l, with intermediate concentrations proportionately scaled in consideration of corresponding intermediate concentrations of copper ions. When a mixture of HEDP and ATMP is employed, preferably comprising about 70 percent HEDP and 30 percent by weight ATMP, it has been discovered that 14 g/l HEDP and 6 g/l ATMP are satisfactory at a copper ion content of 3 g/l while 225 g/l HEDP and 97 g/l ATMP are satisfactory at a copper ion bath concentration of 50 g/l. Corresponding adjustments in the concentrations of HEDP and ATMP are proportionately made when the copper ion concentration is intermediate of the 3 and 50 g/l limits to provide satisfactory chelation with a slight excess of chelating agent present in the bath. Similarly, when a mixture of HEDP and EDTMP is employed, preferably comprising about 50 percent by weight of each compound, it has been discovered that 9 g/l HEDP and 10 g/l EDTMP are satisfactory at a copper ion concentration of about 3 g/l while 145 g/l HEDP and 166 g/l EDTMP are satisfactory at a copper ion bath concentration of about 50 g/l with proportionate adjustments in the concentrations of these two constituents in consideration of intermediate copper ion concentrations. It will also be appreciated that alternative mixtures of chelating agents within the ranges specified will require proportionate adjustments in concentration of total chelating agent present in relation to copper ion concentration in consideration of the foregoing concentration relationships which can be readily calculated and confirmed by routine testing to provide optimum performance for any given conditions in further consideration of the specific examples hereinafter set forth.

A third essential constituent of the copper electrolyte comprises a carbonate compound including bicarbonates of alkali metals and alkaline earth metals. Preferably, sodium carbonate and potassium carbonate are employed to stabilize the electrolyte against pH fluctuations and to further serve as a carrier for contaminating metal ions introduced in the bath as a result of drag-in and dissolution of the parts in the electrolyte during the electrodeposition operation. The use of the alkali metal carbonate has further been observed, depending upon the particular chelating agent used, to inhibit the formation of smutty copper deposits and eliminate dark copper deposits in the cathode low current density areas. Ammonium carbonate has been found undesirable in some instances because of a loss of adhesion of the electrodeposit while calcium carbonate is undesirable because of the tendency to form precipitates in the bath.

The concentration of the carbonate buffer can broadly range from about 3 up to about 100 g/l calculated as sodium carbonate, preferably about 10 to about 20 g/l. Concentrations of the carbonate compound below the recommended minimum concentrations will result in pH fluctuations whereas concentrations above the maximum range specified do not appear to have any adverse effects on the operation of the electrolyte.

Since the carbonate buffer agent and complexing agent are subject to depletion by both decomposition and drag-out a replenishment of these two chemicals to maintain the electrolyte within appropriate composition limits is necessary during commercial operation. This can conveniently be performed on an intermittent or continuous basis in response to an analysis of bath composition by adding the two constituents separately or in admixture in appropriate proportions.

The electrolyte is on the alkaline side and contains hydroxyl ions to provide a pH of from about 7.5 up to about 10.5 with a pH of about 9.5 to about 10 being preferred. Typically an operating pH of about 9.5 has been found particularly satisfactory. The appropriate pH of the electrolyte can be maintained by adding an alkali metal hydroxide to the electrolyte to raise the pH of which potassium hydroxide is preferred. In order to reduce the pH within the desired range, an alkali metal bicarbonate can be employed of which potassium bicarbonate constitutes a preferred material. When the operating pH decreases below the recommended level, it has been observed that the electrolyte tends to promote the formation of immersion deposits. On the other hand, at an operating pH above the recommended range, it has been observed in some instances, that the copper deposit becomes grainy and of a burnt characteristic.

In addition to the foregoing constituents, the bath may optionally further contain a wetting agent or surfactant which is bath soluble and compatible with the other constituents therein. When such a surfactant is employed, it can be used in concentrations up to about 0.25 g/l with amounts of from about 0.01 to about 0.1 g/l being preferred. Typical surfactants suitable for use in the practice of the present invention include polyethylene oxides such as Carbowax 1000, alkyl sulfates such as 2-ethyl hexyl sulfate, perfluro anionic wetting agents, and the like.

In accordance with the process aspects of the present invention, the electrolyte can be operated at a temperature of from about 100° to about 160° F., preferably from about 110° to about 140° F. with temperatures of about 120° to about 140° F. being typical. The specific temperature employed will vary depending on bath composition such as will become apparent in the specific examples subsequently to be described. The bath can operate at a cathode current density of from about 1 to about 80 ASF with a current density of about 5 to about 25 ASF being preferred.

The electrodeposition of the copper deposit can be performed in consideration of the other operating parameters of the bath within a time of as little as 1 minute to as long as several hours or even days with plating times of about 2 minutes to about 30 minutes being more usual for strike deposits. The specific time of electrodeposition will vary depending upon the thickness of the plate desired which will typically range from about 0.015 to about 5 mils.

The electroplating operation is performed by immersing the conductive substrate to be plated in the electrolyte and connecting the substrate to the cathode of a direct current source. It has been found that when the copper ion concentration is above about 20 g/l, it is advantageous, and usually necessary, to electrify the part prior to and during immersion in order to achieve good adherence of the copper plate and ferrous-base substrates. In the case of zinc-base substrates, it has been found essential at all copper ion bath concentrations to electrify the zinc-base substrate prior to and during entry into the bath at a minimum potential of about 3 volts to achieve satisfactory adhesion of the copper plate on the zinc-basis substrate. A combination of anodes are employed for electrolyzing the bath and effecting the deposition of a copper plating on the cathode. The combination of anodes includes a copper anode of any of the types well-known in the art such as an oxygen-free high purity copper anode which is soluble and replenishes the copper ions consumed from the bath by electrodeposition and drag-out. It has been observed that when the concentration of copper ions falls below the recommended minimum concentration, a reduction in cathode efficiency occurs accompanied by burnt deposits. On the other hand, concentrations of copper ions above the recommended maximum range has been observed to adversely affect the adhesion of the copper deposit. While replenishment of copper ions can be effected by the addition of copper salts to the electrolyte, it is preferred to effect replenishment by dissolution of the copper anode at a rate substantially corresponding to the depletion rate of the copper ions by an appropriate adjustment of the copper anode surface relative to the insoluble ferrite anode surface. The specific copper anode surface area to ferrite anode surface area ratio can range from about 1:2 to about 1:6 with a ratio of about 1:3 to about 1:5 being preferred and a ratio of about 1:4 being typical. Moreover, the ratio of the surface area of the cathode to the total anode surface area can range from about 1:2 up to about 1:6, preferably about 1:3 to about 1:5 and typically, about 1:4.

The insoluble ferrite anode employed in controlled combination with the soluble copper anode may comprise an integral or composite anode construction in which the ferrite sections thereof comprise a sintered mixture of iron oxides and at least one other metal oxide to produce a sintered body having a spinnel crystalline structure. Particularly satisfactory ferrite anode materials comprise a mixture of metal oxides containing about 55 to about 90 mol percent of iron oxide calculated as $Fe_2O_3$ and at least one other metal oxide present in an amount of about 10 to 45 mol percent of metals selected from the group consisting of manganese, nickel, cobalt, copper, zinc and mixtures thereof. The sintered body is a solid solution in which the iron atoms are present in both the ferric and ferrous forms.

Such ferrite electrodes can be manufactured, for example, by forming a mixture of ferric oxide ($Fe_2O_3$) and one or a mixture of metal oxides selected from the group consisting of MnO, NiO, CoO, CuO, and ZnO to provide a concentration of about 55 to 90 mol percent of the ferric oxide and 10 to 45 percent of one or more of the metal oxides which are mixed in a ball mill. The blend is heated for about one to about fifteen hours in air, nitrogen or carbon dioxide at temperatures of about 700° to about 1000° C. The heating atmosphere may contain hydrogen in an amount up to about 10 percent in nitrogen gas. After cooling, the mixture is pulverized to obtain a fine powder which is thereafter formed into a shaped body of the desired configuration such as by compression molding or extrusion. The shaped body is thereafter heated at a temperature of about 1100° to about 1450° C. in nitrogen or carbon dioxide containing up to about 20 percent by volume of oxygen for a period ranging from about 1 to about 4 hours. The resultant sintered body is thereafter slowly cooled in nitrogen or carbon dioxide containing up to about 5 percent by volume of oxygen producing an electrode of the appropriate configuration characterized as having relatively low resistivity, good corrosion resistance and resistance to thermal shock.

It will be appreciated that instead of employing ferric oxide, metal iron or ferrous oxide can be used in preparing the initial blend. Additionally, instead of the other metal oxides, compounds of the metals which subsequently produce the corresponding metal oxide upon heating may alternatively be used, such as, for example, the metal carbonate or oxalate compounds. Of the foregoing, ferrite anodes comprised predominantly of iron oxide and nickel oxide within the proportions as hereinabove set forth have been found particularly satisfactory for the practice of the present process.

A ferrite anode comprising a sintered mixture of iron oxide and nickel oxide suitable for use in the practice of the present invention is commercially available from TDK, Inc. under the designation of F-21.

By the proper proportioning of the copper and ferrite anode surfaces, the chemistry of the electrolyte is maintained with appropriate additions of the complexing and buffering agent and small additions, if necessary, of the copper salt. Insufficient ferrite anode surface area results in dull or grainy deposits while an excessive ferrite anode surface area may result in reduced cathode efficiency and progressive depletion of copper anions requiring more frequent replenishment of the electrolyte with copper salts.

Surprisingly, the use of alternative primary insoluble anodes in lieu of the ferrite anode as hereinabove described does not provide satisfactory deposits. For example, insoluble graphite primary anodes have been found to deteriorate producing harmful by-products in the bath which result in smutty deposits.

While the replenishment of the complexing agent during operation of the electrolyte is usually done employing a neutralized alkali metal salt thereof to avoid a drastic reduction in the operating pH of the electrolyte, it is contemplated that the acid form of the complexor can be used for original or new bath make-up by first dissolving the acid form complexor in water followed by the addition of a base such as potassium hydroxide to increase the pH to a level above about 8. Thereafter, the carbonate compound can be added to the preliminary solution in which a neutralization of the complexor has been accomplished in situ.

In order to further illustrate the electrolyte and process of the present invention, the following specific examples are provided. It will be understood that the examples as hereinafter set forth are provided for illustrative purposes and are not intended to be limiting of the scope of this invention as herein disclosed and as set forth in the subjoined claims.

EXAMPLE 1

A cyanide-free aqueous alkaline electrolyte suitable for depositing a copper strike on ferrous-base substrates such as steel and on copper-base substrates such as brass is prepared by dissolving in deionized water, about 60 to about 72 g/l of copper sulfate pentahydrate (15 to 18 g/l copper ions) under agitation. Following the complete dissolution of the copper sulfate salt, about 81 to about 87 g/l of a complexing agent is dissolved comprising the neutralized potassium salt of a 30 percent by weight aminotri (methylene-phosphonic acid) (ATMP) and 70 percent by weight of 1-hydroxyethylidene-1, 1 diphosphonic acid (HEDP). The pH of the solution is adjusted employing a 50 percent aqueous solution of potassium hydroxide to provide a pH of about 8.5. Thereafter from about 15 to about 25 g/l of potassium carbonate is added and the solution is agitated until complete dissolution occurs. The solution is thereafter heated to an operating temperature of from about 110° to about 140° F. and a combination of an oxygen-free, high purity copper anode and a ferrite anode are immersed while suspended from an anode bar to provide a ferrite anode surface area to copper anode surface area of about 4:1.

While agitation is not critical, some agitation such as mechanical, cathode rod and preferably air agitation is employed to provide for improved efficiency and throwing power of the plating process. Steel and brass test panels are electroplated in the foregoing electrolyte for periods of about 2 to 20 minutes at a cathode current density of about 5 to 10 ASF and at a cathode to anode surface area ratio of about 1:2 to about 1:6. The bath is maintained within a pH of about 8.5 to 9.5 and the solution is vigorously agitated by air agitation. Substantially uniform grain-refined, ductile adherent copper strike deposits are obtained.

The foregoing electrolyte is also suitable for copper plating steel and brass parts in a barrel plating operation.

EXAMPLE 2

An electrolyte is prepared identical to that described in Example 1. Zinc test panels are satisfactorily plated employing the same operating parameters as described in Example 1 with the exception that the test panels are electrified at a minimum voltage of 3 volts prior to and during immersion in the electrolyte to provide adherent, grain-refined ductile copper strike deposits.

EXAMPLE 3

A cyanide-free aqueous alkaline electrolyte suitable for depositing a copper strike on ferrous-base substrates such as steel and on copper-base substrates such as brass is prepared by dissolving in deionized water about 25 g/l to 35 g/l of copper sulfate pentahydrate (6.25 to 8.75 g/l copper ion) under agitation. Following the complete dissolution of the copper sulfate salt, about 62.5 g/l to about 78.5 g/l of 1-hydroxy ethylidene-1,1, diphosphonic acid is added. The pH of the solution is adjusted employing a 50 percent aqueous solution of potassium hydroxide to above pH 8.0. Thereafter, from about 15 to about 20 g/l of sodium carbonate is added and the solution is agitated until complete dissolution occurs. The solution is thereafter heated to an operating temperature of from about 130° F. to 140° F. and a combination of an oxygen-free high purity copper anode and ferrite anode is immersed in the bath while suspended from an anode bar to provide a ferrite anode surface area to copper surface area of about 4:1.

Air agitation is employed to reduce burning and to improve throwing power of the process steel and brass panels or parts are electroplated in the foregoing electrolyte for periods of about 2 to 20 minutes at cathode current densities of about 20 to 30 ASF and at a cathode to anode surface area ratio of about 1:2 to about 1:6. The bath is maintained within a pH of about 8.5 to 10.2 and the solution is vigorously agitated by air agitation. Uniform, fine-grained, ductile and adherent copper strike deposits are obtained.

EXAMPLE 4

An electrolyte is prepared identical to that described in Example 3. Zinc test panels or parts are satisfactorily plated employing the same operating parameters described in Example 3 with the exception that the cathode (work) is electrified at a minimum voltage of 3 volts prior to and during immersion in the electrolyte, to provide adherent, fine-grained, ductile copper deposits.

EXAMPLE 5

A cyanide-free aqueous alkaline electrolyte suitable for depositing a copper deposit on ferrous-base substrates such as steel and on copper-base substrates such as brass is prepared by dissolving in deionized water, about 55 g/l to about 88 g/l of copper sulfate pentahydrate (13.5 to 22 g/l of copper ions) under agitation. Following the complete dissolution of the copper sulfate salt, about 100 to about 122 g/l of 1-hydroxyethylidene-1,1, diphosphonic acid are added. The pH of the solution is adjusted employing a 50 percent aqueous solution of potassium hydroxide to provide a pH of about 8.0. Thereafter from about 15 to 25 g/l of sodium carbonate is added and the solution is agitated until complete dissolution occurs. The solution is thereafter heated to about 130° to 150° F. and a combination of an oxygen-free high purity copper anode and ferrite anode is immersed while suspended from an anode bar to provide a ferrite anode surface area to copper anode surface area ratio of about 4:1.

While agitation is not critical, some agitation such as mechanical, cathode rod and preferably air agitation is employed to provide efficiency and throwing power of the process. Steel and brass substrates are electroplated in the foregoing electrolyte for periods of 2 to 60 minutes at a cathode current density of about 10 to 30 ASF and at a cathode to anode surface area ratio of about 1:2 to about 1:6. The bath is maintained within a pH of about 8.5 to 10.2. Uniform, fine-grained, ductile and adherent copper deposits are obtained.

The foregoing electrolyte is also suitable for copper plating steel and brass work pieces in a barrel plating operation.

EXAMPLE 6

A cyanide-free aqueous alkaline electrolyte suitable for depositing a copper deposit on ferrous-base substrates such as steel and on copper-base substrates such as brass is prepared by dissolving in deionized water, about 55 g/l to about 100 g/l of copper sulfate pentahydrate (13.5 to 25 g/l of copper ions) under agitation. Following the complete dissolution of the copper sulfate salt, about 43.5 g/l to 52 g/l of 1-hydroxyethylidene-1,1 diphosphonic acid (HEDP) and 100 to 122 g/l of ethylene diamine tetra (methylene phosphonic acid) (EDTMP) are added. The pH of the solution is adjusted employing a 50 percent aqueous solution of potassium hydroxide to provide a pH of 8.0. Thereafter from about 10 to 25 g/l of sodium carbonate is added and the solution is agitated until complete dissolution occurs. The solution is thereafter heated to an operating temperature from about 130° to about 140° F. and a combination of oxygen-free high purity copper anode and a ferrite anode is immersed while suspended from an anode bar to provide a ferrite anode surface area to copper surface area ratio of about 4:1.

While agitation is not critical, some agitation such as mechanical, cathode rod and preferably air agitation is employed. Steel and brass test panels or parts are electroplated in the foregoing electrolyte for periods of 2 minutes to several days (depending on thickness of copper required) at a cathode current density of about 10 to 40 ASF and at a cathode to anode surface area ratio of about 1:2 to about 1:6. The bath is maintained within the pH range of 8.5 to 10.2. Uniform, fine-grained, ductile and adherent copper deposits are obtained.

The foregoing electrolyte is also suitable for copper plating steel and brass parts in a barrel plating operation.

It will be appreciated that it is not essential to the satisfactory practice of the process and composition of the present invention to prepare the copper electrolytes in the specific sequence and employing the specific ingredients disclosed. For example, the complexing agent or mixture of complexing agents can be introduced in the form of an aqueous concentrate of the potassium salt to provide the desired concentration of the complexing agent. Typically, the acid form of the complexing agent can be first neutralized employing a 50 percent aqueous solution of potassium hydroxide providing a concentrate having a pH of about 8.

While it will be apparent that the preferred embodiments of the invention disclosed are well calculated to fulfill the objects above stated, it will be appreciated that the invention is susceptible to modification, variation and change without departing from the proper scope or fair menaing of the subjoined claims.

What is claimed is:

1. A process for electrodepositing a grain refined ductile and adherent copper strike on a conductive substrate which comprises the steps of providing an aqueous alkaline cyanide-free electrolyte containing copper ions in an amount sufficient to electrodeposit copper, a complexing agent in an amount sufficient to chelate the copper ions present, said complexing agent comprising a compound selected from the group consisting of 1-hydroxyethylidene-1,1-disphosphonic acid, a mixture of 1-hydroxyethylidene-1,1-disphosphonic acid and aminotri-(methylene phosphonic acid) in which said 1-hydroxyethylidene-1,1-diphosphonic acid is present in an amount of at least about 50 percent by weight of the mixture; and a mixture of 1-hydroxyethylidene-1,1-diphosphonic acid and ethylene diamine tetro (methylene phosphonic acid) in which said 1-hydroxyethylidene-1,1-diphosphonic acid is present in an amount of at least about 30 percent by weight of the mixture, as well as the bath soluble and compatible salts and partial salts thereof, a bath soluble and compatible carbonate compound in an amount sufficient to stabilize the pH of the electrolyte, and hydroxyl ions in an amount to provide a pH of about 7.5 to about 10.5, controlling the temperature of said electrolyte between about 100° to about 160° F., immersing a conductive substrate to be plated as a cathode in said electrolyte, immersing a combination of a copper-base soluble anode and a ferrite insoluble anode in said electrolyte to provide a copper anode to ferrite anode surface area ratio of about 1:2 to about 1:6, and passing current between said anodes and said cathode for a period of time sufficient to deposit copper on said substrate to the desired thickness.

2. The process as defined in claim 1 in which said copper ions are present in an amount of about 3 to about 50 g/l.

3. The process as defined in claim 1 in which said copper ions are present in an amount of about 15 to about 50 g/l.

4. The process as defined in claim 1 in which said copper ions are present in an amount of about 3.5 to about 10 g/l.

5. The process as defined in claim 1 in which said hydroxyl ions are present in an amount to provide a pH of about 9.5 to about 10.

6. The process as defined in claim 1 further including a bath soluble and compatible wetting agent present in an amount up to about 0.25 g/l.

7. The process as defined in claim 1 further including a bath soluble and compatible wetting agent present in an amount of about 0.01 to about 0.1 g/l.

8. The process as defined in claim 1 in which said carbonate compound is selected from the group consisting of alkali metal and alkaline earth metal carbonate and bicarbonate compounds and mixtures thereof.

9. The process as defined in claim 1 in which said carbonate compound is selected from the group consisting of alkali metal carbonate and bicarbonate compounds and mixtures thereof.

10. The process as defined in claim 1 in which said carbonate compound comprises potassium bicarbonate.

11. The process as defined in claim 1 in which said carbonate compound is present in an amount of about 3 to about 100 g/l calculated on a weight equivalent basis as sodium carbonate.

12. The process as defined in claim 1 in which said carbonate compound is present in an amount of about 10 to about 20 g/l calculated on a weight equivalent basis as sodium carbonate.

13. The process as defined in claim 1 in which said complexing agent comprises 1-hydroxyethylidene-1,1-diphosphonic acid present in an amount of about 50 to about 500 g/l.

14. The process as defined in claim 1 in which said complexing agent comprises a mixture containing 70 percent by weight 1-hydroxyethylidene-1,1-diphosphonic acid and 30 percent by weight aminotri - (methylene phosphonic acid) as well as the bath soluble and compatible salts and partial salts thereof, said mixture present in an amount of about 20 to about 322 g/l.

15. The process as defined in claim 1 in which said complexing agent comprises a mixture containing about 50 percent by weight 1-hydroxyethylidene-1,1-diphosphonic acid and about 50 percent by weight ethylene diamine tetra (methylene phosphonic acid) as well as the bath soluble and compatible salts and partial salts thereof and mixtures thereof, said mixture present in an amount of about 19 to about 311 g/l.

16. The process as defined in claim 1 in which the step of controlling the temperature of said electrolyte is performed to provide a temperature of from about 110° F. to about 140° F.

17. The process as defined in claim 1 in which the step of controlling the temperature of said electrolyte is performed to provide a temperature of about 120° F. to about 140° F.

18. The process as defined in claim 1 in which the step of passing current between said anodes and said cathode is performed to provide a cathode current density of about 1 to about 80 ASF.

19. The process as defined in claim 1 in which the step of passing current between said anodes and said cathode is performed to provide a cathode current density of about 5 to about 25 ASF.

20. The process as defined in claim 1 including the further step of maintaining the pH of said electrolyte within a range of about 9.5 to about 10.

21. The process as defined in claim 1 including the further step of maintaining the copper anode to ferrite anode surface area ratio between about 1:3 to about 1:5.

22. The process as defined in claim 1 including the further step of maintaining the copper anode to ferrite anode surface area ratio at about 1:4.

23. The process as defined in claim 1 in which the step of passing current is controlled to provide a copper deposit on said substrate of an average thickness of about 0.015 to about 5 mils.

24. The process as defined in claim 1 in which the step of passing current is controlled for a period of time of from about 1 minute to about 1 hour.

25. The process as defined in claim 1 in which the step of passing current is controlled for a time of from about 2 to about 30 minutes.

26. The process as defined in claim 1 including the further step of replenishing said complexing agent and said carbonate compound to maintain said bath constituents within the desired operating range.

27. The process as defined in claim 1 including the further step of controlling the cathode to anode surface area ratio between about 1:2 to about 1:6.

28. The process as defined in claim 1 including the further step of controlling the cathode to anode surface area ratio between about 1:3 to about 1:5.

29. The process as defined in claim 1 including the further step of controlling the cathode to anode surface area ratio at about 1:4.

30. A process for electrodepositing a grain refined ductile and adherent copper strike on a ferrous-base conductive substrate which comprises the steps of providing an aqueous alkaline cyanide-free electrolyte containing copper ions in an amount sufficient to electrodeposite copper, a complexing agent in an amount sufficient to chelate the copper ions present, said complexing agent comprising a compound selected from the group consisting of 1-hydroxyethylidene-1,1-diphosphonic acid, a mixture of 1-hydroxyethylidene-1,1-diphosphonic acid and aminotri - (methylene phosphonic acid) in which said 1-hydroxyethylidene-1,1-diphosphonic acid is present in an amount of at least about 50 percent by weight of the mixture; and a mixture of 1-hydroxyethylidene-1,1-diphosphonic acid and ethylene diamine tetro (methylene phosphonic acid) in which said 1-hydroxyethylidene-1,1-diphosphonic acid is present in amount of at least 30 percent by weight of the mixture, as well as the bath soluble and compatible salts and partial salts thereof, a bath soluble and compatible carbonate compound in an amount sufficient to stabilize the pH of the electrolyte, and hydroxyl ions in an amount to provide a pH of about 7.5 to about 10.5, controlling the copper ion concentration within a range of about 15 to about 50 grams per liter, controlling the temperature of said electrolyte between about 100° to about 160° F., immersing a ferrous-base conductive substrate to be plated as a cathode in said electrolyte, immersing a combination of a copper-base soluble anode and a ferrite insoluble anode in said electrolyte to provide a copper anode to ferrite anode surface area ratio of about 1:2 to about 1:6, and passing current between said anodes and said cathode for a period of time sufficient to deposit copper on said ferrous-base substrate to the desired thickness.

31. The process as defined in claim 30 including the further step of electrifying said ferrous-base substrate prior to and during the step of immersing said substrate in said electrolyte.

32. A process for electrodepositing a grain refined ductile and adherent copper strike on a zinc-base conductive substrate which comprises the steps of providing an aqueous alkaline cyanide-free electrolyte containing copper ions in an amount sufficient to electrodeposit copper, a complexing agent in an amount sufficient to chelate the copper ions present, said complexing agent comprising a compound selected from the group consisting of 1-hydroxyethylidene-1,1-diphosphonic acid, a mixture of 1-hydroxyethylidene-1,1-diphosphonic acid and aminrotri - (methylene phosphonic acid) in which said 1-hydroxyethylidene-1,1-diphosphonic acid is present in an amount of at least about 50 percent by weight of the mixture; and a mixture of 1-hydroxyethylidene-1,1-diphosphonic acid and ethylene diamine tetro (methylene phosphonic acid) in which said 1-hydroxyethylidene-1,1-diphosphonic acid is present in an amount of at least about 30 percent by weight of the mixture, as well as the bath soluble and compatible salts and partial salts thereof, a bath soluble and compatible carbonate compound in an amount sufficient to stabilize the pH of the electrolyte, and hydroxyl ions in an amount to provide a pH of about 7.5 to about 10.5, controlling the copper ion concentration within a range of about 3.5 to about 10 grams per liter, controlling the temperature of said electrolyte between about 100° to about 160° F., cathodically electrifying said conductive zinc-base substrate at a voltage of at least about 3 volts and inmersing the electrified said substrate in said electrolyte, immersing a combination of a copper-base soluble anode and a ferrite insoluble anode in said electrolyte to provide a copper anode to ferrite anode surface area ratio of about 1:2 to about 1:6, and passing current between said anodes and said zinc-base substrate for a period of time sufficient to deposit copper on said substrate to the desired thickness.

* * * * *